United States Patent [19]

Alpert

[11] Patent Number: 4,720,037

[45] Date of Patent: Jan. 19, 1988

[54] SANITARY JACKET FOR ICE CREAM CONES

[75] Inventor: Theodore Alpert, Chicago, Ill.

[73] Assignee: North American Paper Company, Berkeley, Ill.

[21] Appl. No.: 28,002

[22] Filed: Mar. 19, 1987

Related U.S. Application Data

[63] Continuation of Ser. No. 841,202, Mar. 19, 1986, abandoned.

[51] Int. Cl.[4] ..... B65D 3/06

[52] U.S. Cl. ..... 229/1.5 H; 229/DIG. 7; 294/31.2; 426/101; 426/135

[58] Field of Search ..... 229/DIG. 7, DIG. 13, 229/1.5 B, 1.5 H, 87 F; 426/90, 95, 101, 115, 132, 135, 139; 294/27.1, 31.2

[56] References Cited

U.S. PATENT DOCUMENTS

| | | | |
|---|---|---|---|
| 1,800,759 | 4/1931 | Shean | 426/139 |
| 1,854,091 | 4/1932 | Young | 229/1.5 H |
| 1,938,113 | 12/1933 | Schoenfeld | 229/DIG. 7 |
| 2,228,942 | 1/1941 | Balton | 426/139 |
| 2,329,512 | 9/1943 | Clifford, Jr. | 229/1.5 H |
| 2,362,595 | 11/1944 | Torrison | 229/1.5 H |
| 2,462,497 | 2/1949 | Heyman | 426/139 |
| 2,948,452 | 8/1960 | Grogan et al. | 229/DIG. 7 |
| 3,039,881 | 6/1962 | Shapiro | 426/132 |
| 3,351,258 | 11/1967 | Eventash | 229/DIG. 7 |
| 3,596,795 | 8/1971 | D'Ercoli | 229/1.5 H |
| 4,069,996 | 1/1978 | Koziol | 229/1.5 H |
| 4,136,800 | 1/1979 | Christner et al. | 426/101 |
| 4,313,965 | 2/1982 | Weinstein | 426/139 |

*Primary Examiner*—Stephen Marcus
*Assistant Examiner*—Gary E. Elkins
*Attorney, Agent, or Firm*—Neuman, Williams, Anderson & Olson

[57] ABSTRACT

The invention consists of a sanitary jacket that fits around an ice cream cone and serves as a sanitary barrier between the fingers of the person serving the ice cream cone or of the consumer and the cone. The jacket is a hollow enclosure, including a portion which engages the cone to secure the enclosure in place around the cone. It has a length sufficient to surround a substantial linear extension of the ice cream cone.

2 Claims, 4 Drawing Figures

SANITARY JACKET FOR ICE CREAM CONES

This application is a continuation of application Ser. No. 841,202, filed Mar. 19, 1986, abandoned.

BACKGROUND OF THE INVENTION

1. Field of the Invention

The present invention relates to a sanitary jacket, and more particularly to a sanitary jacket that fits around an edible ice cream cone and allows the user of the jacket to handle the cone without touching it and place the cone on a supporting surface without bringing it into contact with the surface.

2. Description of the Prior Art

Restaurant and ice cream shops serve ice cream, frozen yogurt and similar foods in various containers, including those that are edible. The edible containers usually have the shape of a flat bottom cup or a cone which is hollow to receive the ice cream and which has a size that allows the consumer to hold the cone and eat the ice cream. The person serving the ice cream fills the cone with ice cream from a container or a conventional electric ice cream dispensing apparatus. The server then hands the ice cream cone to the consumer.

The manufacturers of the edible cake type ice cream cones or cups do not ordinarily pre-jacket them; they supply them in large packages which contain a great number of cones. Consequently, the server must use a sanitary shield or barrier which allows him or her to handle a cone without touching it. One such shield is a napkin. The server wraps the napkin around the cone and keeps it in place by applying a clamping pressure to the napkin with his or her fingers. While maintaining the napkin around the cone, the server cannot easily move or shift his or her fingers, and thus, finds it difficult to handle the usually fragile cone and serve it to the consumer. In addition, the server cannot place the cone on a supporting surface without using a second napkin as a sanitary barrier between the surface and the cone.

Pre-jacketing of ice cream cones is also known, but has proven unsatisfactory. The jackets used in this process fit tightly around the cone, and an edible adhesive maintains them in place. The adhesive, however, prevents easy removal of the jacket, causing spills and stains to the consumer's clothing. Additionally, the best time to pre-jacket a cone is during the manufacture of the cone. However, the manufacturing processes used to make cake cones and the sizes and shapes of these cones do not allow easy application of a jacket at this time. Thus, the manufacturers pre-jacket sugar cones but not cake cones, the more commonly used type of cone. Finally, pre-jacketing the cones is costly.

The sanitary jacket of the present invention avoids the problems discussed above. The jacket is simple and inexpensive to manufacture. It allows the employees of a restaurant or ice cream shop to serve ice cream cones cleanly and easily; the server to handle and manipulate the ice cream cone without touching it; and the server and consumer to place the cone on a supporting surface without bringing the cone into contact with the surface. The jacket may also receive ice cream which spills from the cone to prevent spills and resulting stains on the server's or consumer's clothing.

SUMMARY OF THE INVENTION

It is a general object of this invention to provide a sanitary jacket for edible ice cream cones.

It is an object of the present invention to provide a simple, inexpensive, and disposable sanitary jacket for ice cream cones and cups.

It is another object of this invention to provide a universal sanitary jacket for ice cream cones of many sizes and shapes which allows the server to handle and manipulate an ice cream cone without touching it.

It is yet another object of this invention to provide a sanitary jacket for ice cream cones which allows the server and the consumer to easily handle the cone without spilling the ice cream which it contains and to place the cone on a supporting surface without bringing the cone into contact with the surface.

Other objects, advantages, and features of the present invention will become apparent upon reading the following detailed description and appended claims and upon reference to the accompanying drawings.

In accordance with the preferred embodiment of the invention, the applicant provides a sanitary jacket which achieves the foregoing objects. This jacket allows the server to handle and manipulate the ice cream cone without touching it, and it allows the server and the consumer to handle the cone easily and cleanly, reducing the risk of spills.

The sanitary jacket is a tapered enclosure made of paper, plastic, or other suitable material. It has an opening for receiving an ice cream cone. When a user places the enclosure on a supported surface, the bottom portion of the enclosure engages the surface, and the enclosure stands freely to support the cone above the surface and prevent contact between the cone and the surface. The enclosure includes a segment which engages the cone to secure the enclosure around the cone. In place, the sanitary jacket covers a substantial portion of the cone's surface area so that the user may manipulate the cone without touching it.

The jacket serves as a barrier between the ice cream cone and the server's and consumer's hands. It also allows the user to place a cone on a supporting surface. The jacket may also receive ice cream which falls or melts off of the ice cream cone to prevent spills and resulting stains on the server's or consumer's clothing.

BRIEF DESCRIPTION OF THE DRAWINGS

For a more complete understanding of this invention, one should now refer to the embodiments illustrated in greater detail in the accompanying drawings and described below by way of non-limiting examples of the invention. In the drawings.

One should understand that the drawings are not necessarily to scale and that the embodiments are sometimes illustrated by graphic symbols, phantom lines, diagrammatic representations, and fragmentary views. In certain instances, the applicant may have omitted details which are not necessary for an understanding of the present invention or which render other details difficult to perceive.

While the drawings and the following text provide a description of the invention in connection with two preferred embodiments, the invention is not limited to these embodiments but rather covers all alternatives, modifications, and equivalents as may be within the spirit and scope of the invention as defined by the appended claims.

DETAILED DESCRIPTION OF THE DRAWINGS AND THE PREFERRED EMBODIMENTS

Figure 1:
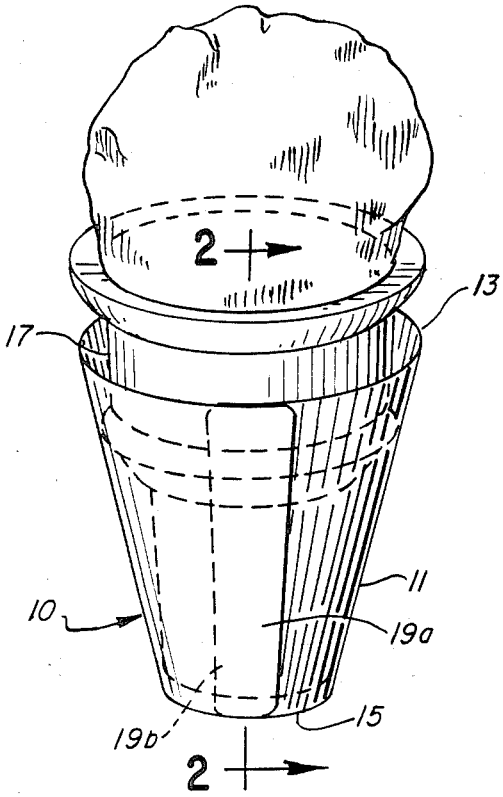
FIG. 1 is a perspective view of the preferred embodiment of the sanitary jacket showing the jacket in place around an ice cream cone.
Figure 2:
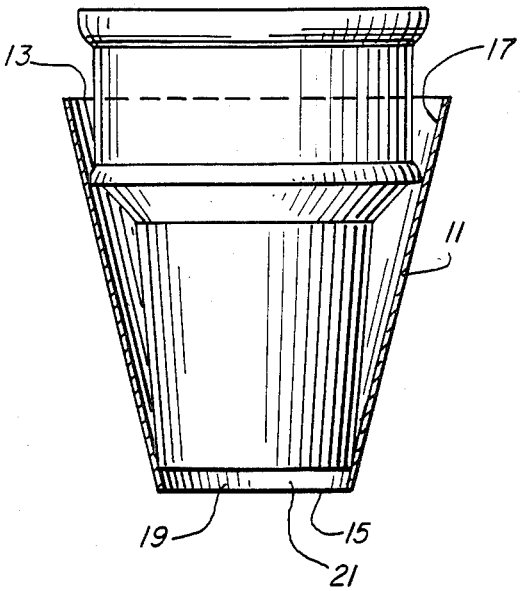
FIG. 2 is a sectional view taken along line 2—2 of FIG. 1.
Figure 3:
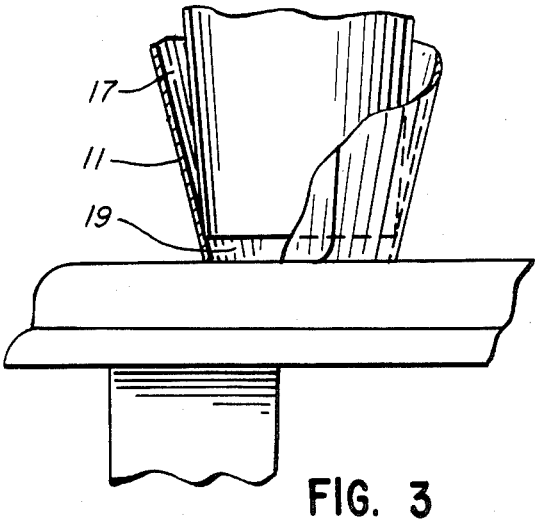
FIG. 3 is a partial elevation view of the sanitary jacket shown resting on a table top and cut-away to expose the ice cream cone disposed within.

Turning now to the drawings, FIGS. 1 through 3 show the first preferred embodiment of a sanitary jacket around an ice cream cone according to the invention generally at 10. In place, the jacket serves as a sanitary barrier allowing the person serving the ice cream cone to handle the cone, fill the cone with ice cream and serve it to the consumer. In addition to serving as a sanitary barrier, the jacket also supports the cone in a free-standing position in which the cone does not contact the supporting surface. The jacket may also receive and collect ice cream that may fall or melt off the cone to prevent spills. Although the drawing and this text provide a description of the sanitary jacket as used with an ice cream cone, the jacket may serve as a sanitary barrier around other foods such as cakes.

The sanitary jacket 11 is a tapered hollow cylinder made of paper or any other suitable, flexible sheet material such as plastic or aluminum foil. This tapered cylinder has a frostroconical configuration and it defines an annular opening 13 at one end and a smaller annular opening 15 at the opposite end. It receives the cone through opening 13, and it covers a substantial linear extension and surface area of the cone. The jacket is flexible to allow the person holding the ice cream cone to firmly grasp the cone between his or her fingers. One method of constructing this jacket is to cut a piece of flexible material and join two elongate sections 19*a* and 19*b* located at opposite sides of the sheet with an adhesive or other attaching means, together in overlapping relation.

When the user or worker places a cone in the jacket, the cone engages the inner surface 17 of the jacket 11 in a press fit before the bottom of the cone can extend through the opening 15 of the jacket. The cone leaves a gap 19 between its bottom and the bottom annular opening 15.

Ice cream which melts or falls off the cone enters into the opening 21 between the jacket 11 and the cone. Thus, the jacket serves to prevent spills that may cause stains to the worker's or consumer's clothing.

The jacket 11 includes a portion 21 circumjacent the bottom annular opening 15 which serves as a base for the jacket-cone assembly. This portion 21 engages a supporting surface (See FIG. 3), and the jacket stands freely to support the cone. Since the cone does not extend below the bottom opening 15, the cone does not contact the supporting surface. Therefore, the jacket prevents contamination of the bottom of the cone.

In placing the jacket around the ice cream cone and using the jacket as a sanitary barrier, the worker follows the following procedure: First, the worker moves the jacket in place around the cone by first allowing the bottom end of the cone to move through opening 13 until the cone engages the inner surface 17 of the jacket. Then, clasping the cone through the jacket, the worker pulls the ice cream cone free from a conventional cone dispensing apparatus which holds the cone with the bottom portion exposed or out of a box containing the cones. The worker then fills the ice cream cone with ice cream and serves it to the consumer.

Figure 4:
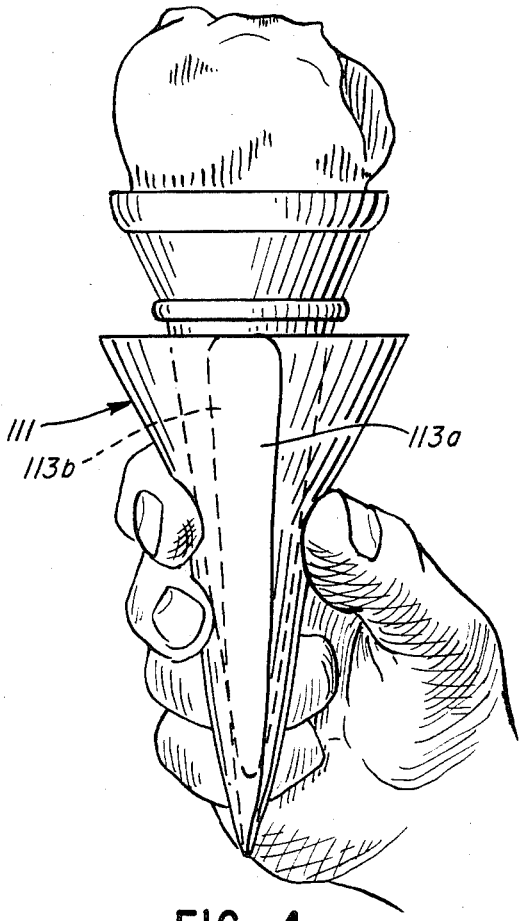
FIG. 4 is a perspective view of an alternative embodiment of the sanitary jacket in place around an ice cream cone and held by a user.

FIG. 4 illustrates a second embodiment of the sanitary jacket of the present invention at 111. This sanitary jacket is a conical enclosure made of paper or other suitable material. Like the first embodiment, it comprises a sheet of this material. An adhesive or other attaching means secures two elongate side portions 113*a* and 113*b* of the sheet in overlapping relation and maintains the sanitary jacket in the configuration shown in FIG. 4. The sanitary jacket houses a substantial linear extension of the ice cream cone from the bottom of the cone and up. Here too, the sanitary jacket serves as a sanitary barrier between the worker and consumer's fingers and the ice cream cone and as a catch for ice cream which may spill from the ice cream cone, preventing stains to the worker's and consumer's clothing.

Thus, the applicant has provided a sanitary jacket for ice cream cones. The jacket serves as a sanitary barrier between the worker's and the consumer's fingers and the edible ice cream cone. The jacket is simple, inexpensive, and disposable. It also functions to prevent ice cream spills.

While the applicant has shown only two embodiments of the invention, one should understand, of course, that the invention is not limited to these embodiments since those skilled in the art to which the invention pertains may make modifications and other embodiments of the principles of this invention, particularly upon considering the foregoing teachings. For example, those skilled in the art may appreciate that one may mold the jacket as one piece of plastic. Additionally, one skilled in the art may appreciate that the jacket may have a wide variety of shapes and configurations. The applicant, therefore, by the appended claims, intends to cover any such modifications and other embodiments as incorporate those features which constitute the essential features of this invention.

What is claimed is:

1. In combination with an ice cream cone, covering a substantial portion of an outer surface of the ice cream cone, and providing a sanitary barrier between a user's fingers and the ice cream cone, the improvement comprising a tapered, cylindrical sanitary jacket disposed around said ice cream cone, said ice cream cone having an upper projection engaging said jacket at an upper portion of said jacket and a lower portion engaging said jacket at a lower portion of said jacket, said ice cream cone and said jacket defining a chamber between said upper projection and said lower portion of said ice cream cone, said jacket including an upper, distal segment projecting freely above said upper projection of said cone and being collapsible to allow the user to firmly grip said cone.

2. The improvement of claim 1, wherein said jacket has a first annular opening through which said jacket receives said cone, a second annular opening, and a base portion circumjacent said second annular opening for engaging a supporting surface and allowing said jacket and said cone to stand freely.

* * * * *